United States Patent [19]

Robnett et al.

[11] 4,217,076

[45] Aug. 12, 1980

[54] LOAD HANDLING VEHICLE WITH ROTATING GRAPPLE MECHANISM

[75] Inventors: James J. Robnett; William H. Herold, both of Portland, Oreg.

[73] Assignee: Raygo Wagner, Inc., Portland, Oreg.

[21] Appl. No.: 942,061

[22] Filed: Sep. 13, 1978

[51] Int. Cl.[2] ..... B66C 23/00

[52] U.S. Cl. ..... 414/735; 92/61; 414/739

[58] Field of Search ..... 414/732, 735, 739; 92/61, 76; 212/8 R, 9, 42, 44; 294/67 BC; 74/51, 128, 519

[56] References Cited

U.S. PATENT DOCUMENTS

| | | | |
|---|---|---|---|
| 2,699,879 | 1/1955 | Bertram | 414/663 X |
| 2,963,185 | 12/1960 | Jones et al. | 414/494 |
| 3,487,964 | 1/1970 | Riley | 414/550 |
| 3,498,473 | 3/1970 | Spaulding et al. | 212/41 |
| 3,567,040 | 3/1971 | Thomson | 212/58 |
| 3,599,818 | 8/1971 | Stanton | 414/607 |
| 3,730,365 | 5/1973 | Herpich et al. | 414/406 |
| 4,016,992 | 4/1977 | Larsen et al. | 414/76 |

FOREIGN PATENT DOCUMENTS

| | | | |
|---|---|---|---|
| 1281863 | 10/1968 | Fed. Rep. of Germany | 414/494 |
| 1902465 | 1/1969 | Fed. Rep. of Germany | 414/663 |

OTHER PUBLICATIONS

"Wood Handling RC200" Poclain May 31, 1978 Canadian Publication.

Teollisuuden Tyojuhadt "Vitraktor" Swedish Publication.

BM-Volvo "Standard Attachments for Allrounders" Swedish Publication.

"Standard Attachments" for Volvo BM Loader LM1641 Swedish Publication.

*Primary Examiner*—Stephen G. Kunin

*Assistant Examiner*—George F. Abraham

*Attorney, Agent, or Firm*—Klarquist, Sparkman, Campbell, Leigh, Hall & Whinston

[57] ABSTRACT

A load-lifting mechanism at the front of a lift truck carries an upright boom with a pair of parallel spaced-apart forwardly cantilevered boom portions rotatably supporting a horizontal pivot tube between their forward ends. A vertical pivot shaft rotatably carried by the pivot tube suspends a grapple beneath the cantilevered boom portions. The grapple includes a yoke mounting and a pair of grapple arms opened and closed by single or dual hydraulic cylinders. A mechanical link interconnects the grapple arms so that they open and close together and to the same extent. A pair of fluid cylinders on the cantilever boom portions pivot the pivot tube to swing the shaft and grapple fore and aft. A rotation mechanism between the cantilever boom portions and their cylinders rotates the pivot shaft and connected grapple about the axis of the shaft. The mechanism is carried by a V-shaped framework supported by the pivot tube and includes a first fluid cylinder connected at one end to the framework and at the other end to a first floating lever rotatably mounted on the pivot shaft. A second floating lever connected to the first lever is also rotatable on the pivot shaft. A second fluid cylinder is connected at one end to the second lever and at the other end to a crank lever fixed to the shaft. By stroking these cylinders to operate the levers, the grapple can be pivoted in either direction through an arc of at least 180° about the axis of the shaft.

13 Claims, 7 Drawing Figures

LOAD HANDLING VEHICLE WITH ROTATING GRAPPLE MECHANISM

BACKGROUND OF THE INVENTION

1. Field of the Invention

The present invention relates to load handling vehicles and more particularly to such vehicles having a rotatable grapple mechanism for handling loads, such as log and pulp wood loaders.

2. Description of the Prior Art

Prior art load handling vehicles having a rotatable grapple device are known. However, these vehicles typically have a rotary hydraulic or other motor which drives a chain or gear to rotate the grapple. Because of the high inertia associated with rotating heavy loads, such as logs, these grapple mechanisms are subject to failure, particularly when rotation of the load is halted. At such times, the gears are often stripped and drive chains broken when resisting the turning load. Although various mechanical braking devices have been employed to stop the rotating loads, these braking devices are also subject to failure because of the stresses placed on them when acting against the inertia of a heavy load.

Furthermore, precise positioning of the load with mechanical braking devices, gears, chain drives or other such mechanisms is extremely difficult.

To overcome the shortcomings of prior grapple rotating mechanisms, it would be desirable to use fluid-powered cylinders to achieve rotation of the grapple. Fluid power is readily available from many vehicles and fluid cylinders used in conjunction with levers can develop high turning and braking forces for their size and weight as compared to other fluid motors. Furthermore, precise positioning control is possible with fluid cylinders, and cylinder-operated mechanisms are usually rugged and easy to service. Also, they do not require the use of gears or a chain and sprocket to transmit or resist turning forces. However, in the known state of the art, fluid cylinder-operated rotation mechanisms are not used to rotate grapples, particularly grapples for handling heavy loads and grapples for which it is advantageous to be able to rotate through an arc of up to 180° and also swing fore and aft.

Although some prior patents suggest cylinder-operated devices for rotating loads about a vertical axis, such devices either require a special purpose vehicle, or provide for rotation through only a limited arc, or would not be adapted to handle large, heavy loads such as logs. In addition, such prior devices are not suitable for operation within the space limitations of a grapple-type lift truck where the cylinder-operated rotation mechanism must be mounted between a pair of cantilevered boom portions and their grapple-swing cylinders. Examples of such prior cylinder-operated rotation mechanisms for special purpose vehicles, but unsuitable for use in a grapple-type lift truck, are found in U.S. Pat. Nos. 3,730,365 and 4,016,992.

Known prior grapple devices commonly use a pair of grapple-mounted cylinders to open and close the grapple arms. Such cylinders tend not to open and close the two grapple arms equally. Some prior grapple devices do use a single grapple-mounted cylinder and a mechanical linkage such as gears or chains to open and close the grapple arms together equally. However such prior linkages tend to be complex and subject to breakage, and hence not entirely satisfactory.

Thus, there is a need for a compact fluid cylinder-operated rotation mechanism capable of rotating a grapple through at least 180° without interfering with the fore and aft powered movement of the grapple and capable of handling heavy loads. There is also a need for a rotatable grapple mechanism having a rugged, simplified powered mechanism for positive opening and closing of the grapple arms together equally.

SUMMARY OF THE INVENTION

The present invention fulfills the foregoing needs by providing a fluid cylinder-operated mechanism for rotating a heavy load-carrying grapple apparatus through up to 180° or more about an upright axis.

Furthermore, the present invention provides such a mechanism which also enables powered fore and aft swinging movement of the grapple.

The fluid cylinder-operated rotating mechanism of the invention includes a compact arrangment of two fluid cylinders and three levers to turn a pivot shaft, and hence a grapple mechanism, about the axis of the shaft through at least 180°. One of these levers is fixed to the shaft, while the other two levers are connected together to float on the shaft. One cylinder is connected to a vertically swingable framework and one of the floating levers, and the other cylinder is connected to the other floating lever and the fixed lever. The swingable framework is carried by the grapple-swinging mechanism.

The invention also includes the incorporation of the previously described rotation mechanism in an overhead load handling apparatus adapted to be pivotally supported by the load lifting portion of a load handling vehicle. The rotation mechanism, including the pivot shaft, is carried by an upper supporting portion of the apparatus with the grapple suspended beneath the supporting portion and rotatable by the pivot shaft.

In addition, the invention includes a combination of a fluid cylinder-operated rotation mechanism with a fluid cylinder operated fore and aft pivoting mechanism for precise positioning of a grapple apparatus and supported load.

Furthermore, the invention includes a simple mechanical link operable with single or dual fluid cylinders for coordinating the opening and closing of the grapple arms of a grapple mechanism. fluid cylinder-operated rotation mechanism capable of pivoting powered vertically swinging load handling apparatus and its load through a large horizontal arc.

Another object is to provide a rotation mechanism as aforesaid capable of providing precise positioning of a load at any point along its arc of rotation.

Another object is to provide a rotation mechanism capable of developing high turning and braking forces while being compact, simple, lightweight, inexpensive and easy to control and maintain.

A further object is to provide a load handling apparatus as aforesaid adapted for attachment to conventional mast or boom type equipment, lift trucks and load handling vehicles.

Another object is to provide a load handling apparatus as aforesaid especially suitable for use in handling truck load sized loads of short pulp wood logs or tree length logs.

Another object is to provide a rotatable grapple apparatus for load handling vehicles capable of rotating a load through up to 180° about an upright axis, swinging the load fore and aft with respect to the vehicle, positioning the grapple apparatus and the load precisely, and tilting the grapple apparatus and load with respect to a vertical or horizontal reference plane to facilitate load handling.

Still another object is to provide a load handling grapple apparatus having grapple arms which are positively coordinated to open and close together equally.

The foregoing and other objects, features and advantages of the present invention will become more apparent from the following detailed description, which proceeds with reference to the accompanying drawings.

DETAILED DESCRIPTION

General Arrangement

Figures 1, 7:
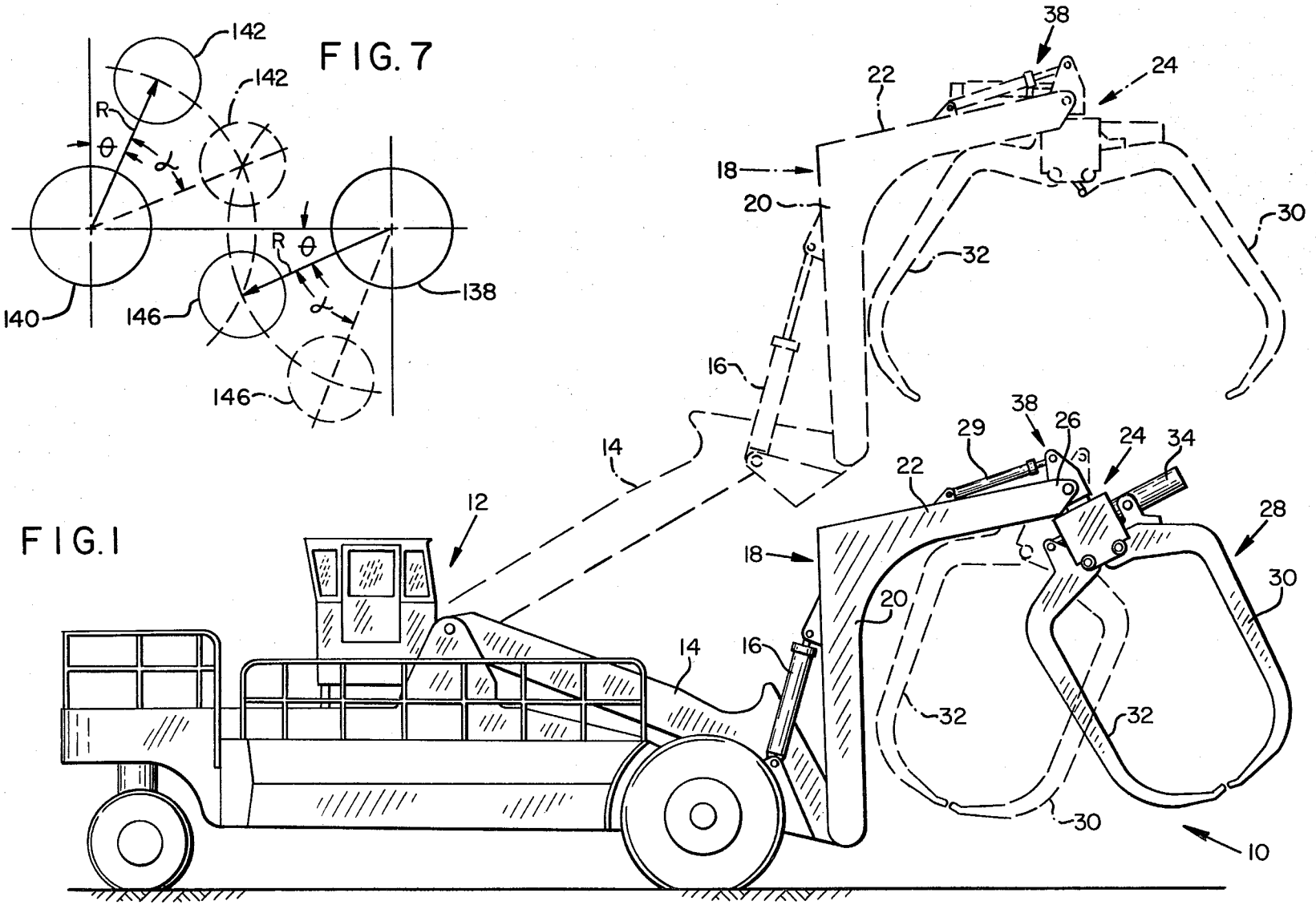
FIG. 1 is a side elevational view of a load handling vehicle having a rotatable grapple apparatus in accordance with the invention.
FIG. 7 is a schematic view of the arrangement of the pivot axes of the grapple coordinating mechanism of FIGS. 5 and 6.

Referring to FIG. 1 of the drawing, a load handling apparatus 10 in accordance with the invention is supported by a load-lifting mechanism of a pneumatic tired load handling vehicle or lift truck 12 designed to lift heavy loads. A vehicle of the type shown is of conventional design and includes a lift boom 14 pivoted at its rear end to the chassis of the vehicle. Hydraulic lift cylinders (not shown) raise and lower the boom. A pair of hydraulic tilt cylinders, one being shown at 16, are connected between the free end of lift boom 14 and load handling apparatus 10. When extended or retracted, cylinders 16 tilt the load handling apparatus forwardly or rearwardly with respect to a vertical plane at the forward end of the lift boom.

In the illustrated embodiment, load handling apparatus 10 includes a pair of parallel spaced-apart tall inverted L-shaped boom members 18 each including an upright boom portion 20 and a cantilevered boom portion 22. Each boom portion 22 projects forwardly and generally perpendicularly outwardly from the upper end of its connected vertical boom portion. A load carriage support assembly 24 suspended between the forward ends 26 of cantilevered boom portions 22 extends downwardly therefrom to rigidly secure at its lower end a load carriage apparatus such as grapple assembly means 28. Grapple assembly 28 includes a pair of grapple arms 30,32 as explained below. A rotation mechanism 38 connected to a pivot shaft 40 (FIG. 3) of support assembly 24 rotates the shaft and hence the grapple assembly and its carried load about the axis of the shaft.

Support assembly 24 is swingable about a horizontal axis to in turn move grapple assembly 28 fore and aft relative to the vehicle 12. A pair of hydraulic load swing cylinders 29, each connected to an associated one of the cantilevered boom portions 22 and to support assembly 24, are operable to cause this fore and aft swinging movement.

Grapple Support Assembly

Figure 4:
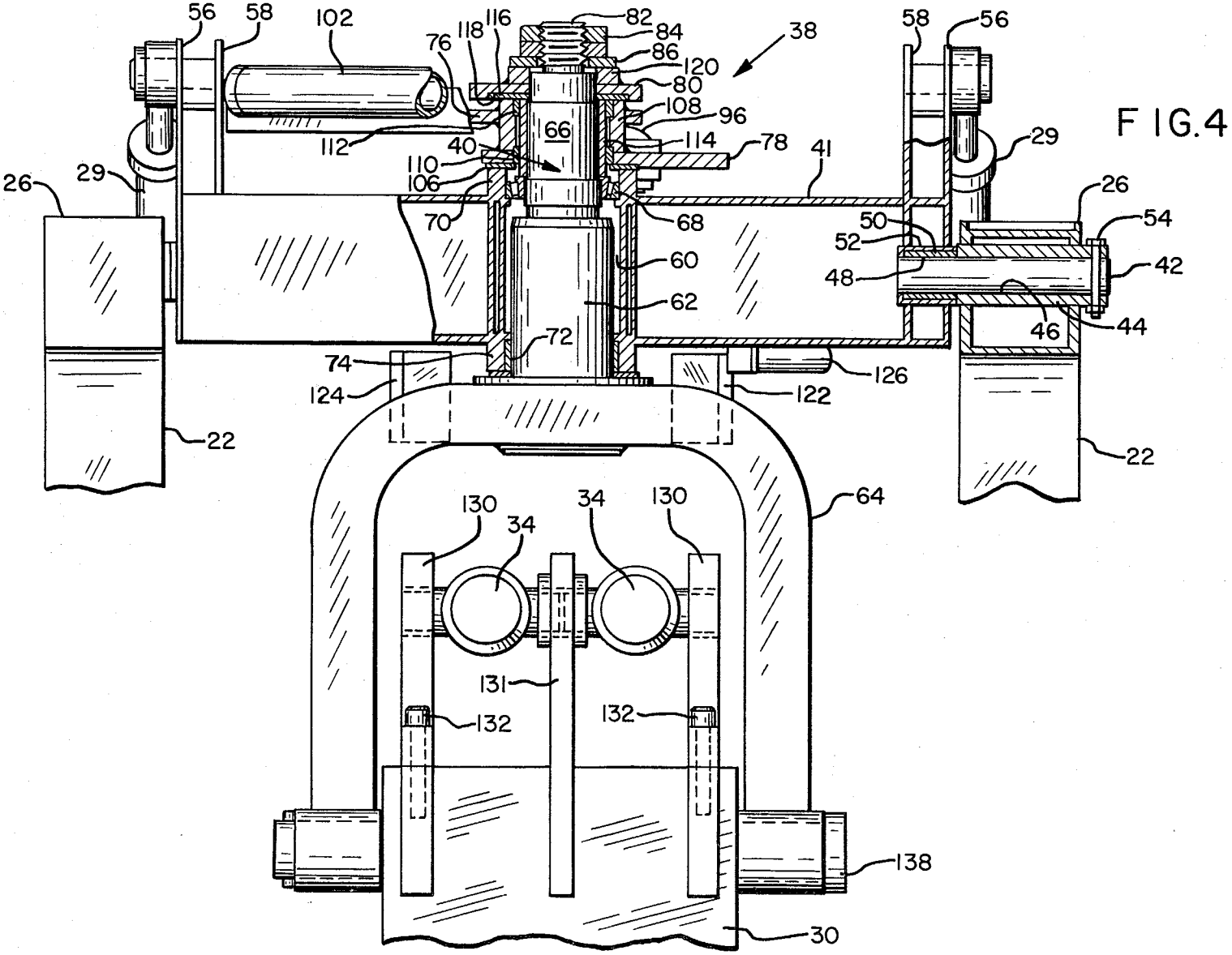
FIG. 4 is a front elevational view, partly in section, of the rotation mechanism of FIGS. 2 and 3 in one operating position.

Referring especially to FIG. 4, grapple support assembly 24 includes a rectangular, rigid, horizontal pivot tube 41 extending between the forward end 26 of the cantilevered boom portions 22. Pivot tube 41 is pivotally supported at each end by a horizontal pivot pin 42 to permit rotation of the pivot tube about a horizontal axis. Each pin 42 passes through a sleeve 44 which defines a bore 46 through a respective one of the cantilevered boom portions, and terminates within a pin receiving bore 48 in the adjacent end of pivot tube 41. A cylindrical bushing 50 lines bore 48 and is held in place and backed by a cylindrical sleeve 52. A keeper bolt 54 prevents pin 42 from sliding outwardly from bore 48.

A pair of parallel, spaced-apart end plates 56, 58 at each end of pivot tube 41 support the sleeve 52 at the same end and include upwardly projecting respective ear portions. The rod end of each hydraulic cylinder 29 is pivoted to the ear portions of an associated one pair of plates 56, 58 so that operation of cylinders 29 pivots tube 41 about its axis.

Pivot shaft 40 is rotatably mounted within an opening 60 through the center of pivot tube 41 with its axis in a vertical plane. Since the pivot shaft is designed to support extremely heavy loads, the shaft is of heavy composite construction as shown and includes a large diameter hollow lower shaft portion 62 for carrying a grapple supporting yoke 64 rigidly connected to its lower end. A smaller diameter upper solid shaft portion 66 of shaft 40 extends within the upper end of hollow shaft portion 62 and is welded thereto. The upper shaft portion is rotatably supported by tapered roller bearings 68 within an anular bearing ring 70 seated within the upper portion of shaft opening 60 and attached to pivot tube 41. Lower pivot shaft portion 62 is supported by anular bearing rings 72 carried by a second bearing ring 74 sealed within the lower portion of shaft opening 60 and attached to pivot tube 41.

Rotation Mechanism

Figure 2:
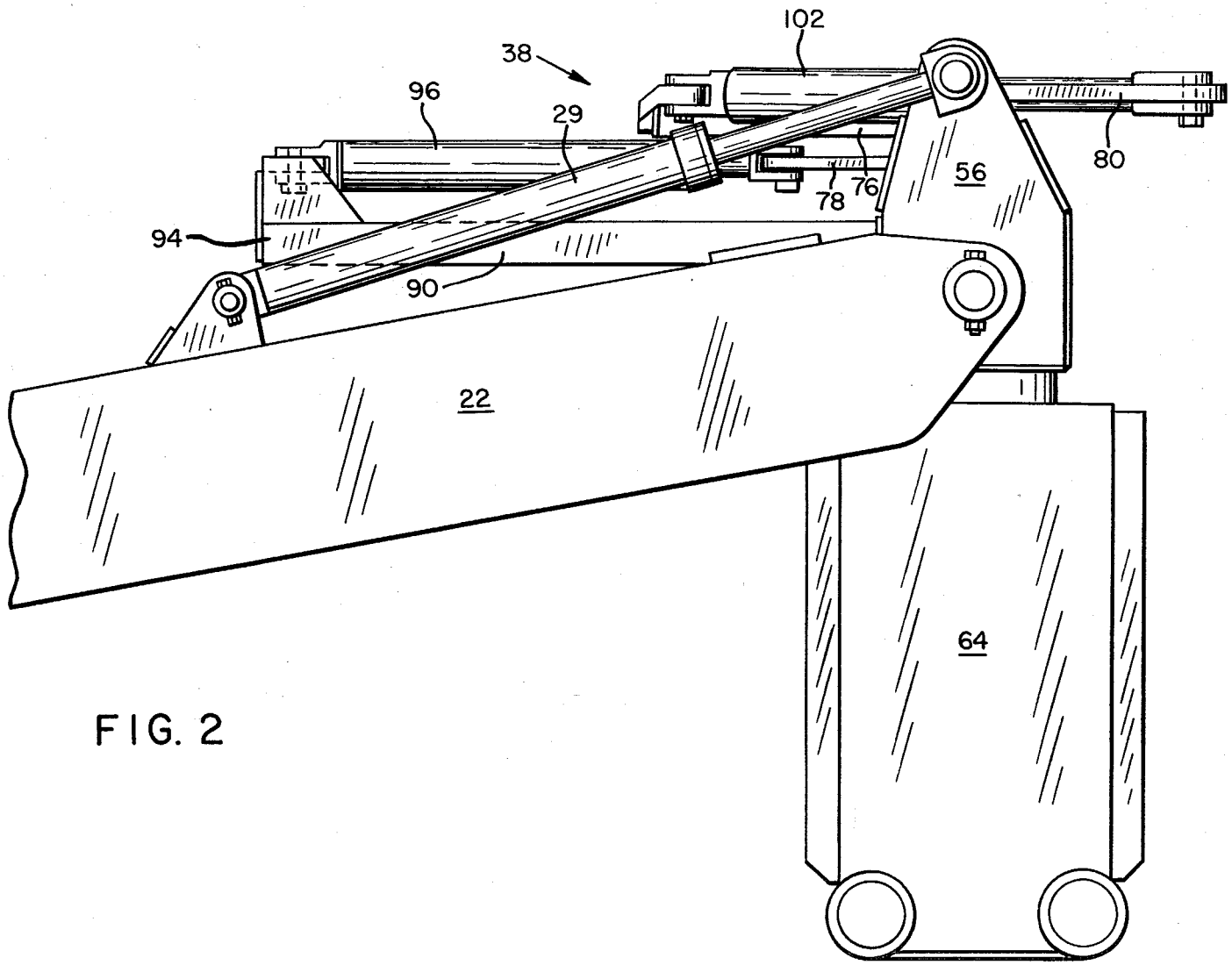
FIG. 2 is a side elevational view of the grapple rotation mechanism of FIG. 1 on an enlarged scale.
Figure 3:
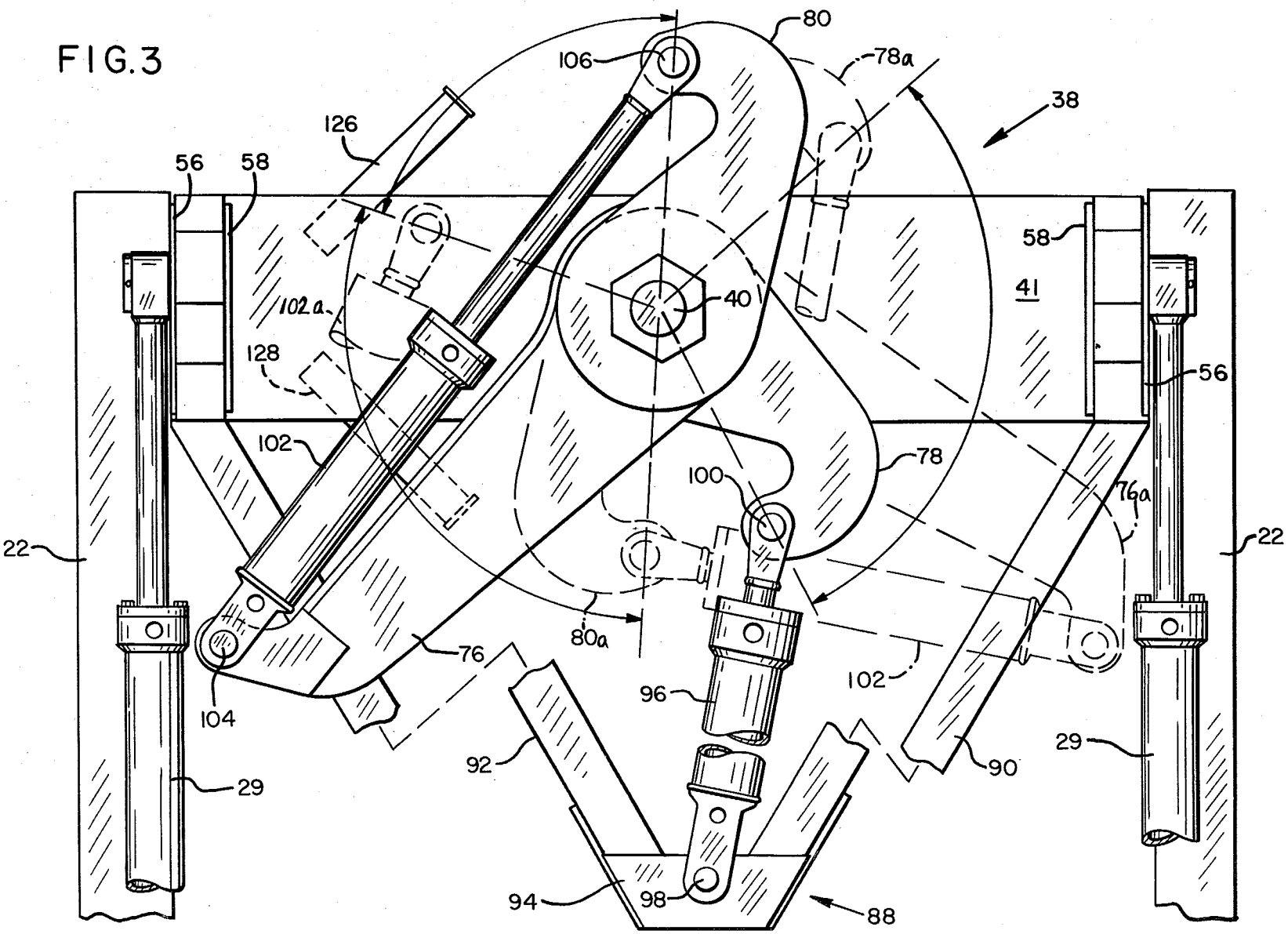
FIG. 3 is a plan view of the rotation mechanism shown in FIG. 2.

Referring especially to FIGS. 2 and 3, rotation mechanism 38 is fluid cylinder operated. A relatively long floating lever 76 with an outturned outer end is rotatably connected to an upper portion of pivot shaft 40 which extends above pivot tube 41. A second shorter floating lever 78, with a hooked outer end, is also rotatably connected to the upper portion of pivot shaft 40. In addition, lever 78 is rigidly connected to and positioned below lever 76 so that these two levers rotate together on and about the axis of the shaft. Floating lever 76 extends outwardly from pivot shaft at an acute angle about the shaft with respect to the direction of extension of floating lever 78 to allow maximum rotation of the pivot shaft by the rotation mechanism within the space between boom portions 22 and between swing cylinders 29. A crank lever 80, of about the same size as lever 78, has a hooked outer end which is affixed to the pivot shaft above floating lever 76 so as to rotate with the shaft. An upper threaded extension 82 (FIG. 4) of the pivot shaft receives nut members 84 and a washer 86 for retaining the shaft, bearing and lever elements in place with respect to the pivot shaft.

Referring again to FIG. 3, a V-shaped, rigid supporting framework 88 includes a pair of leg portions 90, 92. These leg portions have one set of their ends connected together by a connecting member 94 to form the base of the V, centered between boom portions 22. The other end of leg 90 is connected to one end portion of pivot tube 41 while the other end of leg 92 is connected to an opposite end portion of pivot tube 41. Consequently, framework 88 is swingable between boom portions 22 about the axis of pivot tube 41 when the pivot tube is rotated by swing cylinders 29.

A first fluid cylinder 96 is pinned at one end 98 to member 94 midway between cantilevered boom portions 22. The opposite, rod end of cylinder 96 is pinned at 100 to the hooked portion of lever 78. A second fluid cylinder 102, having a somewhat smaller stroke than the first cylinder 96, is pinned at 104 to the outturned end of floating lever 76 and its opposite, rod end, is pinned at 106 to the hooked end of fixed lever 80. The angle about shaft 40 between pin 100 and pin 104 is acute so that the extension of lever 76 from shaft 40 is thus of an acute angle with respect to the extension of lever 78. In addition, the angle about pivot shaft 40 between pins 106 and 104 is less than 180° in all operating positions of the rotation mechanism so that cylinder 102 does not hit shaft 40 or the portions of the levers connected thereto.

It will be apparent from FIG. 3 that retraction of cylinder 102 rotates crank lever 80 counter-clockwise relative to floating lever 76 and about the axis of pivot shaft 40. With this retraction, cylinder 102 moves from its position shown in solid line to its position **102*a* indicated in dashed lines. Because fixed lever 80 is affixed to the pivot shaft, the shaft and its connected grapple also rotate upon the retraction of cylinder 102. Additional rotation of the pivot shaft in the same direction is achieved by extension of cylinder 96. Extension of this latter cylinder rotates floating lever 78 counter-clockwise about the axis of pivot shaft 40 from its position shown in solid lines to its position 78*a* indicated in dashed lines. Since the floating lever is rotatably mounted on the shaft, normally this lever would not turn the shaft. However, because lever 78 is connected to lever 76, rotation of lever 78 causes a corresponding rotation of lever 76 from its position illustrated in solid lines to its position 76*a* shown in dashed lines. Furthermore, because cylinder 102 connects lever 76 to crank lever 80, movement of the lever 76 in response to movement of lever 78 causes similar movement of the fixed lever 80 to its position 80*a* shown in dashed lines. Thereby additional rotation of pivot shaft 40** and its connected grapple mechanism occurs. Operation of the cylinders in the opposite direction causes rotation to the same extent in the opposite direction.

In the cylinder and lever arrangement shown, cylinder 96 has a capability of rotating shaft 40 through an arc of 105° in opposite directions, and cylinder 102 has the capability of rotation shaft 40 through an additional arc of 75°, for a total rotation capability of 180°. Of course, additioal rotation of shaft 40 is also possible by modification of the lever and cylinder rotation mechanism. For example, lever 80 can be made somewhat larger to increase the stroke of cylinder 102 and thereby permit this cylinder to rotate shaft 40 through more than 75°. Naturally, lever 80 would have a radius, measured from the center of shaft 40 to the outer peripheral edge of the lever, which is less than th distance from the axis of shaft 40 to plate 58 so that the lever clears this plate during rotation. Also, by increasing the spacing between the swing cylinders 29 and the cantilevered boom portions 22, longer levers can be employed to allow for additional rotation. Moreover, through the use of appropriate hydraulic controls which are well known in the hydraulics field, the cylinders can be caused to stroke in sequence and to any desired extent for rotation of pivot shaft 40 and its connected grapple load though any portion of the full arc of rotation for precise positioning of the load.

It is important to note that the rotation mechanism is swingable about the axis of pivot tube 41 in all operating positions. That is, regardless of the position of the grapple mechanism along its full arc of rotation, the rotation mechanism is free to swing between cantilevered boom portions 22 so as to not impede the fore and aft swinging of the grapple mechanism by cylinders 29. This is made possible because of the additional clearance created by having the cylinders operate oppositely as explained below. That is, in one extreme rotation position of the grapple mechanism, one of the cylinders 96, 102 is fully extended and the other is retracted. In addition, in the opposite extreme rotational position, the other of such cylinders 96, 102 is fully extended while said one is retracted. Thus, one cylinder is extended and the other is retracted to produce rotation of shaft 40 in the same direction. Consequently, less space is required for the mechanism than if the cylinders both extended to produce rotation of the shaft in one direction and both retracted to produce rotation in the other direction.

Referring again to FIG. 4, the details of the connection of rotation mechanism 38 to pivot shaft 40 will be described. Lever 78 slides in contact with an annular bearing ring 106 supported by the upper surface of bearing ring 70. Lever 78 is connected to a lower portion of a cylindrical sleeve 108 which has lever 76 connected to an upper portion thereof. Bearing rings 110, 112 rotatably couple sleeve 108 to another bearing ring 114 which is coaxial wtih, and rotatable about, the axis of the pivot shaft. Thus, levers 76, 78 are rigidly connected together by sleeve 108 and float about pivot shaft 40.

Crank lever 80 is fixed to shaft 40 and is supported by the upper ends of sleeve 108 and of rings 112, 114. A bearing ring 116 positioned within a recess 118 in the lower surface of the crank lever is positioned between this lever and the crank supporting portion of the sleeve and rings. A collar 120 is secured to the upper surface of lever 80 and beneath washer 86.

Stops 122, 124, mounted to the upper end of yoke 64, engage stops 126, 128 (FIG. 3) secured to the lower surface of pivot tube 41 to stop the load from rotating when the maximum extension and retraction of cylinders 96, 102 is reached. Consequently, stresses associated with the rotating load are not placed on these cylinders when they are in their fully extended or retracted positions. In the illustrated form, these stops have been conveniently set to provide 180° maximum rotation of the grapple mechanism.

Grapple Opening and Closing Mechanism

Figure 5:
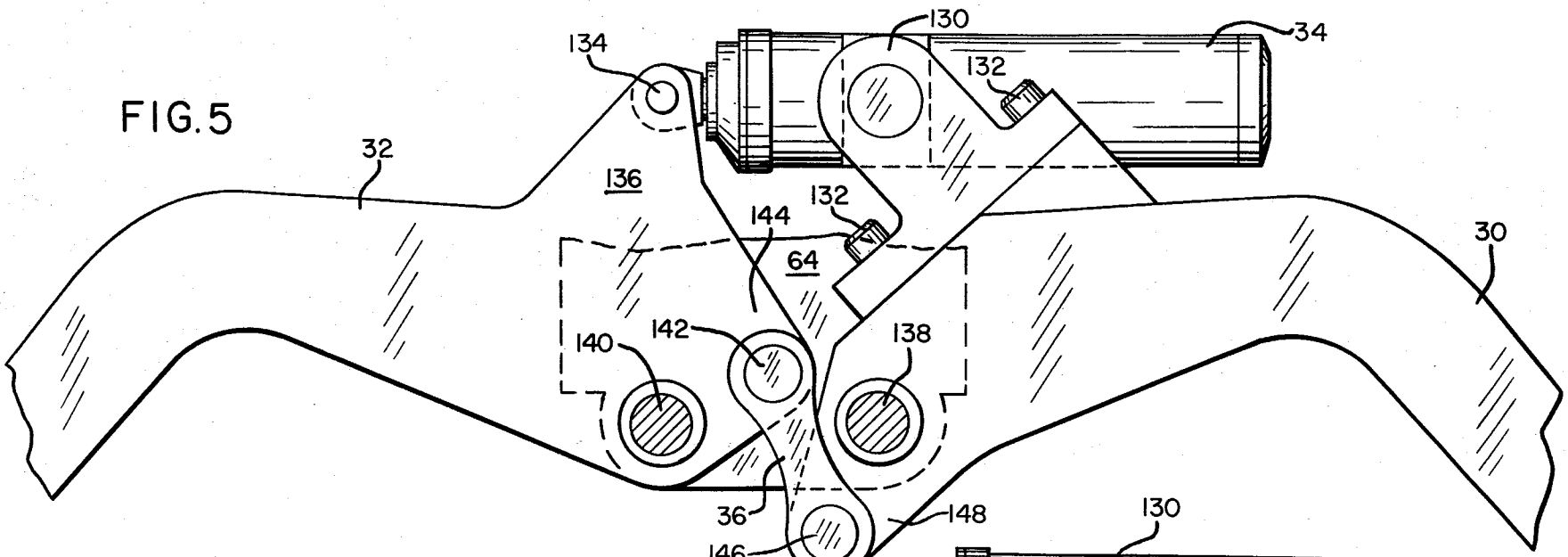
FIG. 5 is a side elevational view of the grapple coordinating mechanism of FIG. 1, on an enlarged scale and with a portion thereof broken away for clarity.
Figure 6:
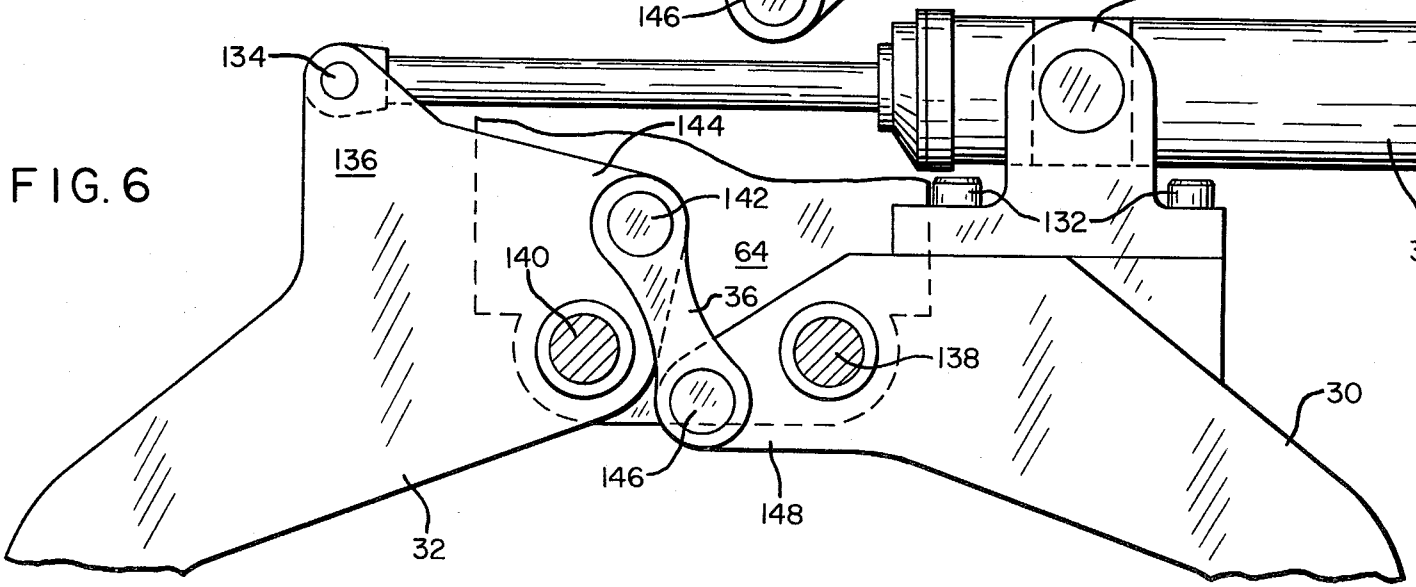
FIG. 6 is a view similar to FIG. 5 but with the grapple coordinating mechanism in a different operating position.

Referring next to FIG. 4, a cylinder mounting bracket includes a pair of spaced apart upwardly projecting plates 130 fastened by bolts 132 to grapple arm 30 and an upwardly projecting fixed plate 131 between plates 130. A pair of grapple operating cylinders 34 have their cases pivoted between a respective one of the plates 130 and plate 131. These cylinders can easily be removed for maintenance or replacement by merely removing supporting plates 130. As shown in FIGS. 5 and 6 for one cyliner 34, the rod end of each cylinder 34 is pinned at 134 to an upwardly projecting ear flange extension of the side of grapple arm 32.

Grapple arms 30, 32 are pivoted by respective horizontal parallel pins 138, 140 to yoke 64 for pivoting about respective pivot axes located in a common plane. The upper end of link 36 is pivoted by a pin 142 to an upwardly projecting nose flange portion 144 of grapple arm 32. The lower end of this link is pivoted by a pin 146 to a downwardly projecting nose flange portion 148 of grapple arm 30. Of course, an additional similar link 36 can be used to connect the grapple arms together at their side not shown in FIGS. 5 and 6. The relationship of the axes of pins 138, 140, 142 and 146 is shown in FIG. 7 and is such that cylinder 34 causes the grapple arms to open and close precisely the same amount together as explained.

Looking at FIG. 7, the radius R between the axes of pins 138, 146 is the same as the radius R between the axes of pins 140, 142. In addition, an acute angle is defined between a first reference plane containing the axes of pins 138, 140 and a plane passing through the axes of pins 138, 146. The same angle exists between a second reference plane perpendicular to the first reference plane and a plane passing through the axes of pins 140, 142. More specifically, in the illustrated form, $\theta$ is equal to about 24°. In addition, each of the pins 142, 146 move through an angle of about 44° when the grapple assembly is operated between its fully open position shown in dashed lines in FIG. 7 and its fully closed position shown in solid lines in this figure. It will be appreciated that, with this mechanical link arrangement, that grapple arms 30, 32 are positively coordinated to operate together.

For example, from the fully open grapple position, with the rod of cylinder 34 retracted as shown in FIG. 5, extension of the rod pivots grapple arm 32 about the axis of pin 140. This in turn moves the upper end of link 36 about the same axis. Consequently, the other end of the link is moved about the axis of pin 138. This causes grapple arm 30 to pivot about the axis of pin 38 the same amount and in an opposite direction from the pivoting of grapple arm 32. The fully closed position of the grapple mechanism is shown in FIG. 6.

Operation

In a log handling operation, the vehicle would normally approach a loaded log truck with the grapple 28 open and lift boom 14 raised as shown in phantom in FIG. 1. When near the truck, boom members 18 are tilted by cylinders 16 and the grapple mechanism is swung by cylinders 29 and rotated by rotation mechanism 38 as required to position the grapple mechanism above the logs.

Boom 14 is then lowered until grapple arms 30, 32 surround a load of logs. Any final alignment of the load engaging grapple during lowering of boom 14 is accomplished through operation of tilt cylinders 16, swing cylinders 29 and rotation cylinders 96, 102. With the grapple arms in position, cylinder 34 closes the grapple arms around the load and boom 14 is raised until the logs clear the truck. The logs are then carried to the place where unloading is desired, such as to a log deck.

It is desirable in many instances to be able to rotate the grapple mechanism through at least 180°. For example, with this capability, the load handling vehicle can approach a log truck from either side or end and parallel to the truck. The grapple can then be rotated 90° in either direction as required to grasp the logs within the grapple arms. Also, it may be required to reverse a load end for end (i.e. 180° or more) to, for example, present logs butt first to a debarking machine. To accomplish rotation of the grapple assembly, cylinders 96, 102 of rotation mechanism 38 are operated as required to rotate levers 76, 78, 80 and hence pivot shaft 40 and the loaded grapple the desired amount.

The combined operation of tilt cylinders 16 and swing cylinders 29 also facilitates maintenance of the rotating mechanism. Thus, with swing cylinders 29 fully extended, the grapple assembly is swung toward upright boom portion 20 as shown in phantom in the lower portion of FIG. 1. At the same time, with tilt cylinders 16 extended, rotating mechanism 38 is positioned near to the ground. Consequently, access to the rotation mechanism for lubrication and other necessary maintenance can be accomplished without the need for workmen to climb ladders. Therefore, it is easier and safer to maintain and repair the load handling vehicle of the invention.

In the foregoing description, only one application of the rotation mechanism has been described. It will be obvious, however, to those skilled in the art that such mechanism has numerous other applications, wherever rotation of a shaft or load through a substantial arc in opposite directions is desired. Also, although the rotation mechanism is shown applied to one specific type of load handling apparatus, such mechanism has broad application to many other types of load handling devices and particularly to vehicle mounted load handling apparatus, and particularly where rotation of the load carriage axis is desired and little clearance exists for operation of a rotation mechanism.

Having illustrated and described what is presently the preferred embodiment of the invention and a preferred application thereof, it will be apparent to those skilled in the art that the same permits of modification in arrangement, detail and application. We claim as our invention all such modifications as come within the true spirit and scope of the following claims.

We claim:

1. In a load handling vehicle having a load-lifting mechanism at its forward end for handling heavy loads, a boom means for attachment to said load-lifting mechanism including a boom portion extending forwardly of said vehicle;

a load carriage means spaced below said boom portion;

a pivot shaft means rotatably supported by said boom portion with its axis in a generally vertical plane and extending downwardly from said boom portion, a lower portion of said pivot shaft means being affixed to said load carriage means to suspend and rotatably support said load carriage means below said boom portion;

and fluid cylinder operated rotation means carried by said boom portion and connected to said pivot shaft means for pivoting said pivot shaft means in opposite directions about the axis thereof and thereby pivoting said load carriage means and any load carried thereby to the same extent;

said fluid cylinder operated rotation means including a first floating lever rotatably connected to said pivot shaft means, a second floating lever rotatably connected to said pivot shaft means and to said first lever so that said first and second levers are rotatable together about said pivot shaft means, a first fluid cylinder pivotally connected at one end to said boom portion and at its other end to said first floating lever for rotating said first floating lever and thereby said second floating lever about said pivot shaft means in opposite directions, a third fixed lever affixed to said pivot shaft means for rotation therewith, and a second fluid cylinder connected pivotally at one end to said second floating lever and at its other end to said fixed lever for pivoting said fixed lever in opposite directions, whereby operation of said first cylinder causes rotation of said floating and fixed levers and thus said pivot shaft means in one direction about the axis of said pivot shaft means and operation of said second cylinder causes rotation of said fixed lever relative to said second floating lever and thus additional rotation of said shaft means in the same said one direction.

2. An apparatus according to claim 1 in which said first cylinder is operable to rotate said pivot shaft means in one direction when said first cylinder is extended and said second cylinder is operable to rotate said shaft in the same said one direction when said second cylinder is retracted.

3. An apparatus according to claim 1 in which said first and second cylinders are operable to rotate said pivot shaft means through an arc of at least 180°.

4. An apparatus according to claim 1 in which the angle about said pivot shaft means between the pivot axis of the connection of said first lever and the pivot axis of the connection of said second cylinder to said second lever is acute, and in which said fixed lever projects outwardly from said pivot shaft means such that the angle about said pivot shaft means between the pivot axis of the connection of said second cylinder to said fixed lever and the pivot axis of the connection of said second cylinder to said second lever is less than 180° in all operating positions of said rotation means, said first cylinder being connected to said framework at a location such that extension of said first cylinder rotates said pivot shaft means in one direction and retraction of said second cylinder rotates said pivot shaft means in the same one direction.

5. An apparatus according to claim 4 in which said first cylinder is operable to rotate said pivot shaft means in opposite directions through an arc of at least 105° and said second cylinder is operable to rotate said pivot shaft means in opposite directions through an arc of at least 75°.

6. An apparatus according to claim 1 in which said boom portion includes a generally horizontal shaft supporting member rotatable about a generally horizontal axis and which includes means for pivoting said supporting member;

said pivot shaft means being connected to said shaft supporting member so as to swing about the axis of said supporting member when said supporting member is pivoted, whereby said load carriage means is swingable about the axis of said shaft supporting member and at the same time rotatable about the axis of said pivot shaft means.

7. An apparatus according to claim 6 in which said boom portion includes a pair of parallel spaced-apart boom sections cantilevered forwardly of said vehicle, said shaft supporting member being connected between the forward ends of said boom sections, said boom portion including a cylinder supporting framework connected to said shaft supporting member so as to be rotatable about the axis of such member between said boom sections, said one end of said first cylinder being connected to said cylinder supporting framework, and said rotation mechanism being sized to permit swinging thereof between said boom sections in all of its operating positions with the pivoting of said supporting member.

8. An apparatus according to claim 5 in which said first and second cylinders are operable to rotate said pivot shaft means through an arc of at least 180°.

9. An apparatus according to claim 8 in which said second lever is longer than said first lever, said second lever projecting rearwardly of said horizontal pivot axis toward said vehicle and being positioned within an area between vertical planes passing through said boom sections in all operating positions of said rotation mechanism so as to be shielded by said boom sections from falling debris and other objects.

10. In a load handling vehicle having a load-lifting mechanism at its forward end for handling heavy loads, a boom means for attachment to said load-lifting mechanism, said boom means including an upright boom portion and a pair of parallel spaced-apart boom sections cantilevered forwardly of said vehicle from the upper end of said boom portion;

a horizonal shaft supporting member extending between the forward ends of said boom sections and mounted thereto for pivoting about a generally horizontal axis;

means for pivoting said shaft supporting member;

grapple assembly means spaced below said boom sections;

pivot shaft means rotatably supported by said shaft supporting member with its axis in a vertical plane and extending downwardly from said boom portion, a lower portion of said pivot shaft means being affixed to said grapple means to suspend and rotatably support said grapple assembly below said boom sections;

and fluid cylinder operated rotation means carried by said cylinder supporting framework and connected to said pivot shaft means for pivoting said pivot shaft means in opposite directions about the axis thereof through an arc of at least 180° and thereby pivoting said grapple assembly and any load carried thereby to the same extent, said fluid cylinder operated rotation means including a first floating lever rotatably connected to said pivot shaft means, a second floating lever rotatably connected to said pivot shaft means and rigidly connected to said first lever so that said first and second levers are rotatable together about said pivot shaft means, a first fluid cylinder pivotally connected at one end to said cylinder supporting framework and at its other end to said first floating lever for rotating said first floating lever and thereby said second floating lever about said pivot shaft means through at least about 105° in opposite directions, a third fixed lever affixed to said pivot shaft means for rotation therewith, and a second fluid cylinder connected pivotally at one end to said second floating lever and at its other end to said fixed lever for pivoting said fixed lever through at least about 75° in opposite directions, said rotation means being operable such that extension of said first cylinder causes rotation of said floating and fixed levers and thus said pivot shaft means through at least about 105° in one direction about the axis of said pivot shaft means and retraction of said second cylinder causes rotation of said fixed lever relative to said second floating lever and thus additional rotation of said pivot shaft means at least about an additional 75° in the same said one direction, and said rotation mechanism being sized so as to be capable of swinging between said boom extensions in all operating portions thereof when said shaft supporting member is pivoted.

11. An apparatus according to claim 10 in which said grapple assembly means includes a first grapple arm rotatable about the axis of a first pivot pin and a second grapple arm rotatable about the axis of a second pivot pin parallel to the first pin;

a mechanical link pivoted at one end by a third pivot pin to said first grapple arm at a location below a first reference plane containing the axes of the first and second pins and between the set of planes perpendicular to said first reference plane, one of which contains the axis of the first pin and the other of which contains the axis of the second pin, said link being pivoted at its other end by a fourth pivot pin to said second grapple arm at a location above the first reference plane and between said set of planes, the angle between the first reference plane and a plane containing the axes of said first and third pins being equal to the angle between a second reference plane perpendicular to said first reference plane and a plane containing the axes of said second and fourth pins; and at least one hydraulic cylinder having its rod end connected to said first grapple arm and its casing end connected to said second grapple arm, whereby extension and retraction of said cylinder causes said grapple arms to open and close precisely the same amount together.

12. A fluid cyllinder-operated rotation mechanism for operation within a confined space comprising:

a pivot shaft rotatable about an axis, and rotatably mounted on a support means;

a first lever mounted for rotation on said shaft about said axis;

a second lever shorter than said first lever mounted for rotation on said shaft about said axis and connected to said first lever for rotation therewith;

a third lever shorter than said first lever affixed to said shaft for rotation therewith about said axis;

a first fluid cylinder interconnecting said first and third levers;

a second fluid cylinder interconnecting said second lever and said support means at a position spaced from said axis;

the small angle between said first and third levers being an obtuse angle when said first cylinder is extended and an acute angle when said first cylinder is retracted;

the small angle between said first and second levers being an acute angle;

the small angle between said second and third levers being an obtuse angle in both the extended and retracted positions of said first cylinder;

whereby said shaft can be rotated in the same direction upon retraction of said first cylinder and extension of said second cylinder through a total arc of at least 180° while said first lever swings through a total arc of less than 180°.

13. An apparatus according to claim 11 including a pair of said hydraulic cylinders for causing said grapple arms to open and close, and also including mounting bracket means for pivotally supporting the casings of said hydraulic cylinders, said mounting bracket means including a pair of parallel spaced apart outer casing support plates removably fastened to the upper end of said second grapple arm and projecting generally upwardly therefrom and an inner casing support plate positioned between said outer casing support plates, and in which the casing of one said hydraulic cylinder is pivoted to one side of said inner casing support plate and an inner side of one of said outer casing support plates while the other said hydraulic cylinder is pivoted to the other side of said inner casing support plate and an inner side of the other of said outer casing support plates.

* * * * *

UNITED STATES PATENT AND TRADEMARK OFFICE

CERTIFICATE OF CORRECTION

PATENT NO. : 4,217,076

DATED : August 12, 1980

INVENTOR(S) : JAMES J. ROBNETT and WILLIAM M. HEROLD

It is certified that error appears in the above-identified patent and that said Letters Patent are hereby corrected as shown below:

Page 1, Inventors, change "William H. Herold" to --William M. Herold--;

Column 2, line 47, after "mechanism." and before "fluid cylinder-operated" begin a new paragraph and insert --A primary object of the invention is to provide a--;

Column 5, line 35, change "line" to --lines--;

line 61, change "rotation" to --rotating--;

Column 6, line 23, change "rotation" to --rotational--; and

Column 9, line 37, after "first" (first occurrence) insert --cylinder to said--.

Signed and Sealed this

*Twenty-eighth* Day of *October 1980*

[SEAL]

*Attest:*

SIDNEY A. DIAMOND

*Commissioner of Patents and Trademark*

*Attesting Officer*